United States Patent [19]

Hansen et al.

[11] 4,073,950

[45] Feb. 14, 1978

[54] EASY OPENING SPIRALLY WOUND DOUGH CAN

[75] Inventors: Eldon D. Hansen; Douglas A. Edmonson, both of Minneapolis, Minn.

[73] Assignee: The Pillsbury Company, Minneapolis, Minn.

[21] Appl. No.: 590,366

[22] Filed: June 25, 1975

[51] Int. Cl.[2] ..... B65D 85/36; B65D 17/24

[52] U.S. Cl. ..... 426/128; 229/4.5; 229/21; 206/830; 426/122; 426/123

[58] Field of Search ..... 229/4.5, 21, 51 BP; 426/122, 123, 128

[56] References Cited

U.S. PATENT DOCUMENTS

| | | | |
|---|---|---|---|
| 2,681,284 | 6/1954 | Graves | 229/51 BP |
| 3,035,753 | 5/1962 | Erekson | 229/51 BP |
| 3,304,185 | 2/1967 | Fortney | 229/51 BP |
| 3,441,197 | 4/1969 | White | 229/51 BP |
| 3,724,742 | 4/1973 | Henderson | 229/51 BP |
| 3,940,496 | 2/1976 | Turpin et al. | 229/51 BP |

*Primary Examiner*—William Price
*Assistant Examiner*—Bruce H. Bernstein
*Attorney, Agent, or Firm*—James V. Harmon; Michael D. Ellwein

[57] ABSTRACT

A dough container is described which consists of a spiral body stock winding of paperbased material, a liner bonded to the interior of the body and label bonded to the exterior surface of the body material. Each of these layers consists of a helically wound strip. The side edges of the body stock strip lie adjacent one another to form a butt joint and the liner is provided with a zigzag fold or pleat substantially in alignment i.e. beneath the butt joint in the body stock. Metal ends are crimped to each end of the can to form the top and the bottom. During opening, the pleat allows the dough which is usually under pressure to expand, separate the butt joint and then rupture the liner.

15 Claims, 13 Drawing Figures

FIG. 1
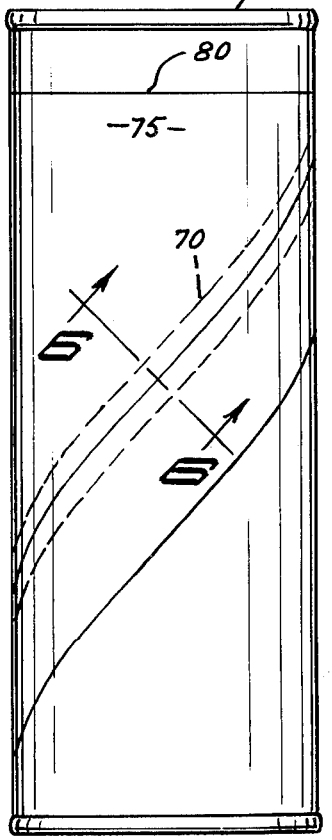
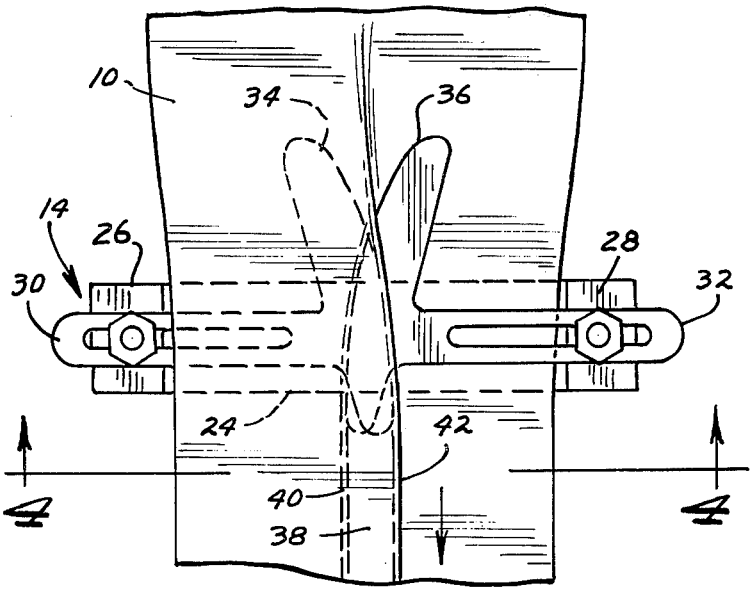
FIG. 3
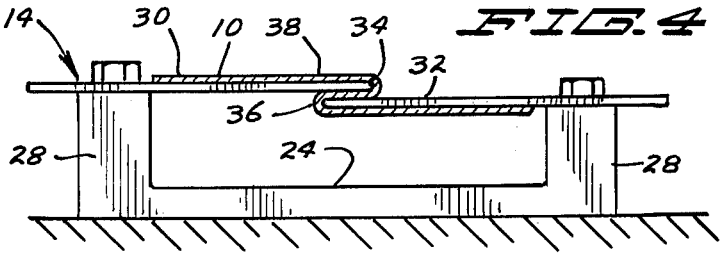
FIG. 4
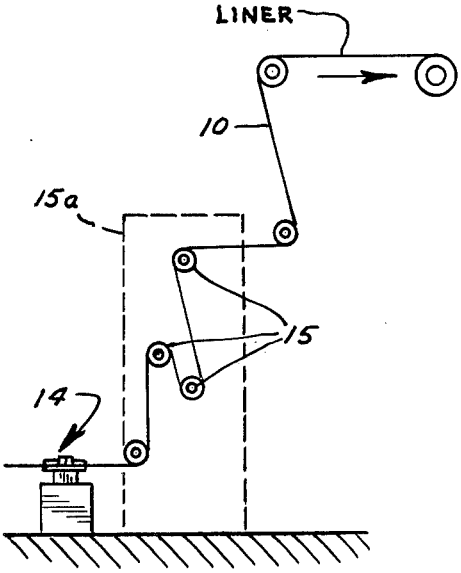
FIG. 2
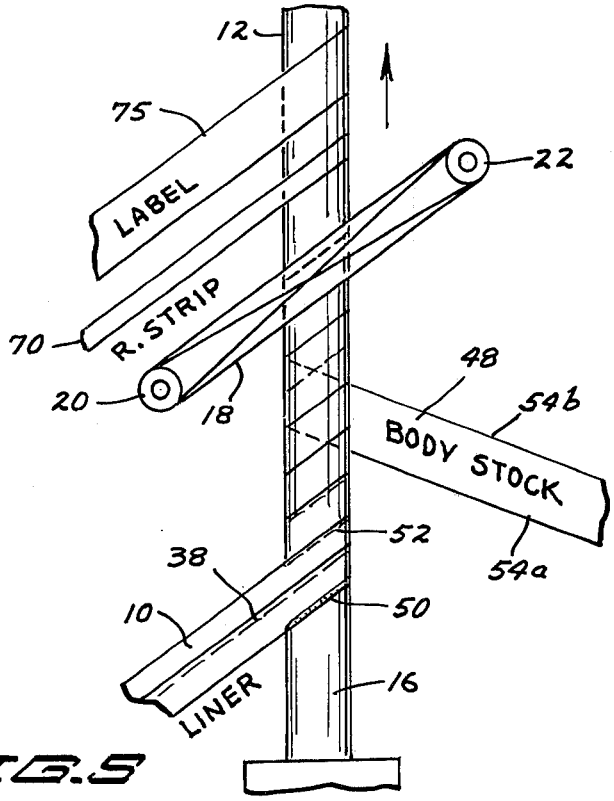
FIG. 5

FIG. 6
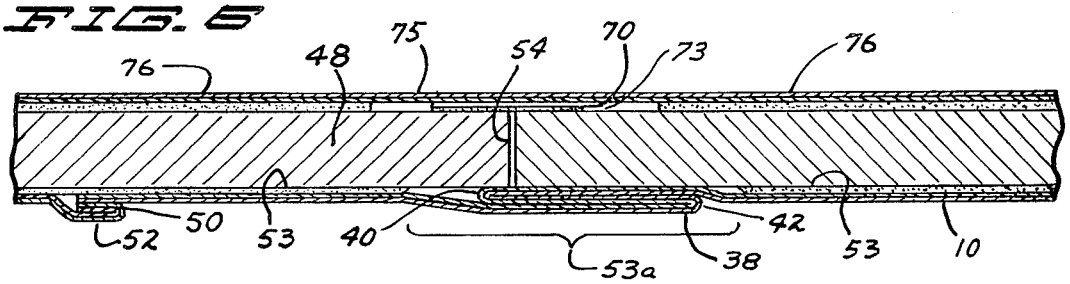
FIG. 7
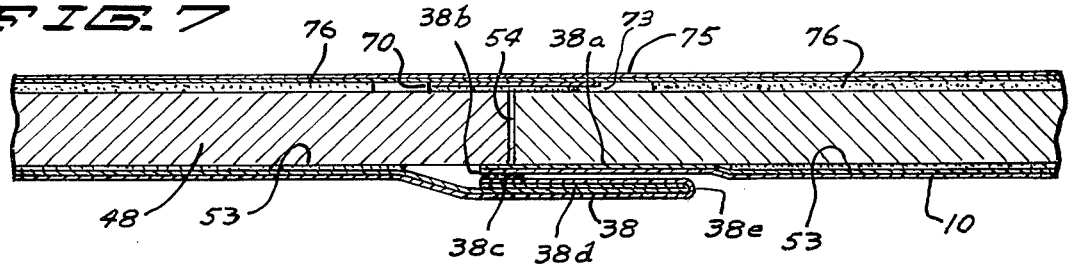
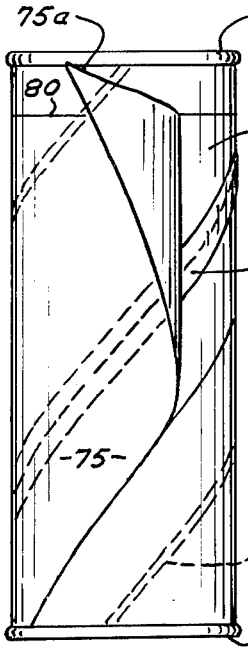
FIG. 8
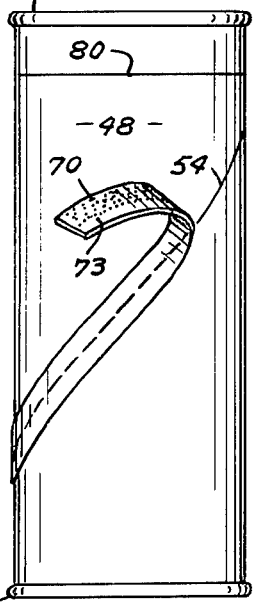
FIG. 9
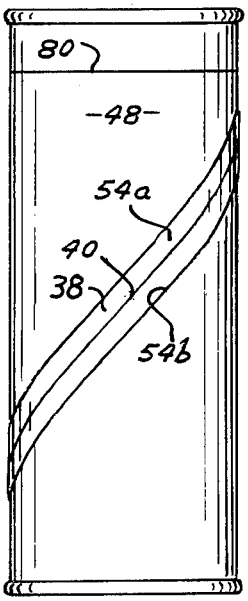
FIG. 10
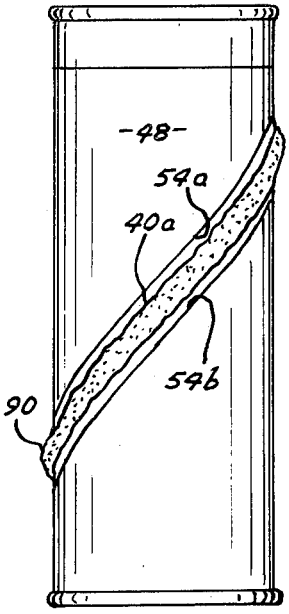
FIG. 11
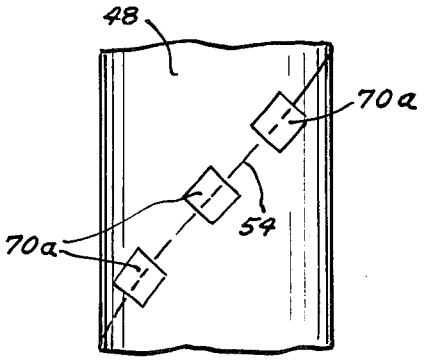
FIG. 12
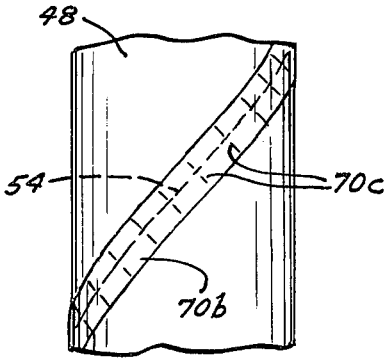
FIG. 13

EASY OPENING SPIRALLY WOUND DOUGH CAN

FIELD OF THE INVENTION

The invention relates to food containers and more particularly to spirally wound dough cans adapted to be easily opened in either one or two steps without the necessity of subjecting the can to impact or other external pressure.

THE PRIOR ART

While a great many spirally wound dough containers have been previously proposed, the most common now in use are exemplified by U.S. Pat. Nos. 2,793,126; 2,793,127 and 3,144,193 all of which describe dough containers wherein the outer layers of material i.e., the label is removed first. The container is then struck against a solid object to rupture the liner which bridges a line of weakness in the body wall thereby allowing the contents of the package to be removed. While these cans perform admirably for the most part, they are not always completely satisfactory. One problem is that containers occasionally do not open unless struck five or six times against a table, and it appears that the more the container is struck, the greater becomes the likelihood for the end to fly off. This decidedly is not the manner in which the container was intended to open. If an attempt is made to remove the biscuit through the open end of the can, they will in all likelihood be damaged, misshapen and lose a substantial amount of the contained gas thereby causing the volume of the finished biscuits to be quite low. Even if this does not happen, users sometimes have difficulty striking and opening the containers and the application of the external force is both time consuming and troublesome.

Another problem with these prior containers is that all of the strength necessary to hold a container intact during shipment and storage must be provided by the label and liner. Accordingly, the label and liner must be relatively heavy and consequently, expensive.

In the course of the development work undertaken in evolving the present invention, it was found desirable to be able to determine the precise moment of opening of the container. In many instances the container opens with an audible pop which can be disturbing if unexpected. Therefore, designs tried by us in which the precise moment of opening could not be controlled were considered less satisfactory than those in which the moment of opening is controlled.

THE OBJECTS

The major objects of the invention are to provide (a) an improved spirally wound dough can which is either self opening after the label has been removed or, at least does not need to be struck against a solid object to be opened, (b) can be opened more easily than spirally wound dough containers now in use, (c) opens with less noise than existing containers, (d) can be constructed in such a way that it does not produce an audible pop when opened, (e) can be designed for either one or two step opening, (f) includes a provision for determining the precise moment of opening, (g) means are provided which make the container more positive acting when it is opened than previous containers, (h) provision is made to utilize a lighter weight label and liner thereby reducing production costs.

THE FIGURES

FIG. 1 is a side elevational view of a can embodying the invention.

FIG. 2 is a semi-diagramatic end elevation of one preferred liner winding operation.

FIG. 3 is a plan view of the liner creasing operation.

FIG. 4 is a horizontal transverse sectional view taken on line 4—4 of FIG. 3.

FIG. 5 is a semi-diagramatic plan view of the can winding operation in accordance with one preferred method of forming containers embodying the invention.

FIG. 6 is a partial sectional view of a can wall taken along line 6—6 of FIG. 1.

FIG. 7 is a view similar to FIG. 6 showing a modified form of the invention.

FIG. 8 is a side elevational view of a can embodying the invention during the first stage of opening with a portion of the label pulled back.

FIG. 9 is a view similar to FIG. 8 showing the next stage of opening after the label has been removed with a portion of the retaining tape removed.

FIG. 10 is a side elevational view showing the next stage of opening, and

FIG. 11 is a view showing the container after the dough has begun to emerge from the spiral opening in the wall of the container.

FIG. 12 is a partial side elevational view of a modified form of the invention, and FIG. 13 is a partial side elevational view of still another modified form of the invention.

SUMMARY OF THE INVENTION

A dough can is described which comprises a spirally wound body member formed from a paperbase strip material, a liner adjacent to the interior of the base material and a label bonded to the exterior surface of the body material. Each of these layers consists of a helically wound strip. The body stock layer has a spirally extending line of weakness which is preferably defined by its side edges which lie adjacent one another to form a butt joint. Since no glue is present in the butt joint an area of weakness extends helically of the can along this line. The liner is provided with an expandable zigzag fold or pleat comprising at least three overlapping layers of material. The pleat terminates along its side edges in at least two parallel helically extending marginal lines located substantially in alignment with the butt joint in the body stock. Sheet metal closure members are fastened to each end of the can after being filled to form the top and the bottom thereof and a circumferentially extending cut is preferably provided near one end. The cut extends at least through the label to allow the label to be peeled away from the body stock. The pleat then enables the dough within the can which is usually under pressure to first expand the butt joint and then to rupture the liner thereby allowing the contents of the package to be removed. The opposite side edges of the liner are preferably bonded together to define a liner seal. The liner seal may be located at a point remote from the butt joint, that is to say, spaced circumferentially from the butt joint or if desired the seal can be located adjacent to the butt joint of the body stock layer. In one embodiment of the invention a strip or tab member formed from sheet material is removably bonded across the butt joint in the body stock layer to temporarily hold the butt joint together after the label is removed.

DESCRIPTION OF THE PREFERRED EMBODIMENTS

In FIGS. 1 through 5, it will be seen that a liner 10 used in forming a tube 12 (FIG. 5) from which cans are to be cut is first passed through a creasing assembly 14 as it travels from left to right in FIG. 2 and 5, proceeding toward a mandrel 16 upon which the tube 12 is formed in an otherwise standard tube forming operation utilizing a standard tensioning and driving belt 18 entrained over driven rolls 20 and 22 to continuously advance strip material on the mandrel 16 so that laminations are built up in spiral or helical fashion as the tube 12 is formed thereon.

The creaser 14 comprises supporting base 24 having a pair of spaced uprights 26 and 28 to which are secured creasing blades 30 and 32 formed from sheet metal and having smoothly contoured inward guide edges 34 and 36 respectively to continuously form a pleat or zigzag fold 38 as the strip is advanced. Fold 38 consists of three overlapped layers of liner material with two longitudinally extending fold lines 40 and 42. The width of the zigzag fold or pleat 38 can be varied widely, but in most practical applications for dough cans which weigh less than a pound, a width of a fraction of an inch and preferably between about $\frac{1}{8}$ inch and $\frac{3}{4}$ inch is used. Outstanding results were obtained with a width of about $\frac{3}{8}$ inch to 9/16 inch. The liner material should be formed from a strong, supple sheet material and is preferably resistant to the penetration of moisture and oil. One suitable liner is a 25 pound machine glazed wet strength kraft paper sheet laminated to 0.0035 inch aluminum foil having a heat sealable vinyl lacquer on its inside surface. As the liner sheet 10 is wound onto the mandrel 16, adhesive such as a polyvinyl acetate resin dispersion adhesive is applied to the liner to bond the liner to the next layer (the bodystock layer 48) used in forming the tube. The degree of weakness produced by the fold lines 40 and 42 can be changed as desired by the number and location of the tension rolls 15 in the roll stand 15a.

Just before the liner 10 is wound onto the mandrel 16, one edge 50 of the liner 10 as shown in FIG. 5 is turned up and folded onto itself to provide a pleat at the edge which is sealed to the opposite edge of the liner by the application of adhesive or by heat sealing as shown at 52, all as described in U.S. Pat. No. 3,156,401. It should be noted that in FIGS. 5 and 6 the entire width of the folded over area 50 e.g., $\frac{1}{8}$ inch is sealed to the opposite edge of the liner to form the seal 52. This seal is similar to that described in U.S. Pat. No. 3,156,401.

The relative longitudinal spacing of the liner 10 and body stock layer 48 that are wound continuously into the tube 12 is adjusted so that the pleat or fold 38 is located almost exactly in alignment with and beneath the butt joint 54 defined by body stock edges which form as the tube is being wound (FIGS. 5 to 11). It should be noted that adhesive 53, applied between the body stock and the liner is interrupted in the area **53*a* (FIG. 6) where the pleat 38 is located. It is preferred that the unbonded area 53*a* be provided to assure that the pleat will expand freely as the container is opened later without portions of the pleat remaining bonded to the body stock 48. The container can be opened satisfactorily if the portion of the pleat in contact with the body stock layer 48 at the right of the butt joint 54 is bonded to the body stock material all the way to the edge of the butt joint 54 as seen in FIG. 6 but not beyond that point proceeding toward the left in the figure. Similarly, the adhesive 53 should not be allowed to extend so far toward the butt joint 54 from the left hand side, as seen in the figure, to bond either the edges of the butt joint together or bond the layer of the pleat 38 together so that the pleat itself will not unfold as described below. One can having a length of $5\frac{3}{8}$ inches and a diameter of 2 inches utilizes a winding angle for layers 10, 48, 70 and 75** of about 50° relative to the axis of the mandrel. The width of each of the liner, the label and the body stock is about $4\frac{1}{8}$ inches and the collar cut is located $\frac{1}{2}$ inch from the end of the can. The can size will, of course, vary depending upon the amount of product being packed.

The pleat or zigzag fold 38 must be sufficiently wide to dissipate the force of the pressure within the dough before rupture. We have found in the case of a can about 2 inches in diameter, a pleat about $\frac{3}{8}$ of an inch wide will usually be satisfactory depending, of course, upon the dough pressure used. If not wide enough, the force of the opening and the associated noise will be excessive; if too wide, liner material is wasted and all of the dough pressure is dissipated by expansion of the pleat with none left to cause the pleat to rupture. Accordingly, it is preferred that the pleat be between about $\frac{1}{8}$ inch and $\frac{3}{4}$ inch in width.

The body stock can be formed from a variety of available packaging materials in sheet or strip form such as kraft paper or cylinder board e.g. as a 0.0026 inch single side newsprint, vatlined cylinder board. This material is characterized by having relatively short newsprint fibers on its surface which are easily pulled out when the label is removed during opening of the container. If kraft paper is used as the body stock layer 48, the label must be bonded to the kraft paper in such a way that it can be removed without delaminating the surface layer of the kraft paper.

Once the body stock layer 48 has been applied to the liner, an optional opening strip or tape 70 is bonded in place over the butt joint with a suitable adhesive. Strip 70 is formed from any suitable sheet material such as paper, foil, cellophane or even masking tape having a width of $\frac{3}{4}$ inch and a thickness of 0.006 inch. It is preferred that the strip 70 or the tabs **70*a* or 70*b*** be brightly colored and marked with instructions indicating that they should be removed to open the container, etc.

The width of the tape 70 is not considered critical but satisfactory results have been obtained with tapes about $\frac{3}{4}$ inch to 1 inch wide or more and the butt joint 54 located at precisely the center of the tape. It is preferred that an area along one edge of the strip 70 be free from adhesive as shown at 73 so that the edge can be lifted.

The strip 70 is removably bonded across the butt joint 54 to temporarily hold the butt joint 54 together after the label 75 has been removed.

After the strip 70 has been applied, the label 75 can be bonded in place as shown in FIG. 5 by adhesive 76 applied on either side of the strip 70. While the material from which the label is formed can be varied widely, a typical label is made of 40 pound machine glazed wet strength kraft paper adhesive bonded to 0.0003 inch aluminum foil. As shown in FIGS. 6 and 7, the adhesive layer 76 is interrupted in the area of a butt joint to accomodate the strip 70 so that the strip 70 will not inadvertently become bonded to the label 75. In a typical case, a non-glued area approximately $\frac{1}{4}$ inch wide is provided on either side of the pleat 38 and on either side of the tape 70. The label and the liner can be adhered to the body stock with a variety of adhesives such as animal glue, dextrins or hot melt adhesives. A preferred adhesive applied at least at the edges 52 of the liner to seal them together is a thermoplastic vinyl heat seal coating. This joint is sealed by the application of heat as the can is being wound. Other adhesives can be used such as contact adhesive or hot melt adhesives in place of the thermoplastic vinyl coating. The liner and label can also be adhered by spray adhesives such as a spray adhesive dispensed from a pressurized container.

The finished can consists of the helically wound liner 10 bonded by means of adhesive 53 to the inside surface of a helical body stock layer 48 with its edges bonded together at 52 as shown in FIGS. 5, 6 and 8. The pleat 38 in the liner 10 is located beneath the butt joint 54 and optionally a temporary retaining strip 70 is bonded over the butt joint 54 beneath the helically wound label 75 which is itself held in place by the adhesive 76. After the can is completed, it is cut to can length in standard fashion and a circumferentially extending cut 80 is applied near one end as described in the first three patents mentioned above. The bottom of the can 82 is seamed in place and the can is filled with dough. The cover 84 is applied and seamed in place conventionally.

Refer to FIG. 7 which illustrates the modification of the design of FIGS. 1 through 6 wherein the same numbers refer to corresponding parts. In FIG. 7, the seal between the edges of the liner 10 instead of being located circumferentially from the butt joint 54 as shown at 52 in FIG. 6, is located adjacent to the butt joint 54 and is, in effect, one side edge of the zigzag fold or pleat 38. Thus, the pleat 38 of FIG. 7 includes a first section **38*a* which lies in contact with the body stock 48 and terminates at 38*b* on the left. A short section, usually about $\frac{1}{3}$ or less the width of the pleat 38, say for example 20% of the width of the pleat 38 as indicated at 38*c*, is bonded to the extreme opposite free edge of the liner 10. The bond 38*c* is typically about $\frac{1}{8}$ inch wide whereas the entire pleat 38 is about $\frac{3}{8}$ inch wide. Thus, the pleat 38 of FIG. 7 comprises the margin 38*a* of the liner which lies in contact with the body stock 48 the terminal edge portion 38*b* which is sealed at 38*c* to the opposite edge portion of the opposite margin of the liner 38*d* which is folded at 38*e* back upon itself to define an unsealed free portion between the fold 38*e* and the seal 38*c*** that is capable of expanding to accomodate the dough as the dough itself expands when the container is opened.

In the course of development of the present invention, it was discovered that the crease **38*e* or the creases at 40 and 42 on the opposite edges of the pleat 38 of FIG. 6 and 3** weaken the pleat somewhat to provide a line along which the liner ruptures during opening as will be described more fully below.

Refer now to FIG. 12 which shows a modified form of the invention. In FIG. 12 the sealing strip 70 is divided into a plurality of segments or pieces **70*a* which define tabs that can be removed manually when the can is to be opened. An important advantage of the contruction of FIG. 12 is that with one or two of the tabs 70*a*** placed in strategic locations on the can, for example exactly intermediate the can ends, the quick removal of one tab will cause the can to immediately open thereby eliminating any uncertainty as to the precise moment of opening. This, in turn, prepares the person opening the can for the popping noise made by the can when it opens if the dough in the cans is under pressure.

FIG. 13 shows a further modified form of the invention in which the strip 70 comprises a strip divided into a plurality of segments each separated from the next by transversely extending perforations **70*c* which divide the strip 70*b*** into connected pieces that can be removed one at a time. This again provides the advantage of allowing the users to control precisely when the can will open.

The manner in which the can is opened will now be described with reference to FIGS. 8 through 11.

The collar cut 80 defines a lifting tab **75*a* at the extreme upper edge of the label 75 where the side edges of the label intersect the cut 80. The label is lifted by the tab 75 and peeled back thereby exposing the tape 70. When the tape 70 is present it is then lifted as shown in FIG. 9 and peeled downwardly thereby weakening the butt joint which now has nothing to hold it together so that the edges 54*a* and 54*b* of the butt joint 54 separate from one another exposing the underlying pleat 38 which expanded outwardly through the opening provided between the edges of the butt joint as the pressurized dough within the container itself expands. As this takes place the pleat 38** unfolds and a bulge forms all along the helical opening. Most dough currently being marketed usually has a pressure of 10–40 psi after being in the can for a few days. However, in some the pressure may be as low as 3–5 pounds. If there is no pressure, opening is accomplished by twisting the ends of the can after the label is removed instead of solely as the result of expansion of the dough.

The crease 40 is then split by the dough pressure as shown at **40*a* in FIG. 11 thereby exposing the dough 90**. The can is opened the rest of the way by twisting its ends, and the dough is removed either in one piece or as individual biscuit size pieces as the case may be.

When no tape 70 is employed the can may be thought of a a single step opening can which opens by itself as soon as the label 75 is removed. The advantage of such an embodiment is that only one step is required for opening. A minor drawback in the design is that since the precise moment of opening is not known when the dough is under pressue, the user can be surprised by the pop made when the can opens. When the tape 70 is used, the can will open precisely when the tape is removed. The moment of opening is even more precisely controlled in the embodiments of FIGS. 12 and 13. The individual tabs are removed one by one and opening occurs when one of the tabs **70*a* or 70*b* is removed. The user will, therefore, not be surprised by the noise. In the event the can contains a non-pressurized product or one containing only a small amount of pressure, the embodiment using no tape or tabs is preferred. In that event, opening would be accomplished by removing the label 75 and thereafter twisting the ends of the can whereupon the liner will rupture along the fold line 42**.

In a preferred form of the invention the helically extending line of weakness in the body wall comprises the edges of the butt joint 54. However, if the edges of the butt joint 54 are glued together another helically extending line of weakness would have to be provided in the body wall, for example by making a line of helically extending perforations or slits in the body wall. The unglued butt joint 54 is preferred since no separate steps are required to produce it and no force is required to cause its separation. It should be understood that where appearance and moisture proofness is not important the label need not extend around the entire surface of the exterior surface of the body wall but could simply comprise a strip or tape of sheet material bonded over the helically extending butt joint throughout substantially its entire length and having sufficient strength to hold the butt joint and the body wall together throughout the normal shipment and storage period of the container.

The embodiment illustrated in FIG. 7 is formed in a different manner from that of FIG. 6 namely by folding over a margin of the liner 10 to form a hem or pleat 38 of the same width as that illustrated in FIG. 6 and bonding the extreme marginal edge of this pleat to the opposite edge of the liner 10. When the embodiment of FIG. 7 opens, the seal 38*c* itself will usually rupture after the pleat has expanded fully.

It can be seen that the invention provides a simple, yet reliable can that can be opened in either one or two steps along a helical line extending essentially the entire length of the container, and the precise moment of opening can be reliably controlled. The invention also provides control over the force of the opening and an opportunity to use a relatively light weight label which is therefore less expensive owing to the reinforcing effect of the strip 70.

What is claimed is:

1. A dough container comprising a spirally wound body wall member formed from a paper base strip having its edges lying adjacent one another to define a spirally extending butt joint which produces a line of weakness along the length of the can, a liner formed from flexible sheet material adjacent to the interior of the body wall member, a label formed from flexible sheet material in strip form bonded to the exterior surface of the body member, the liner and label both extending spirally with respect to the axis of the can, the marginal edges of the label being offset circumferentially with respect to the butt joint between the adjacent edges of the spirally wound body member, the liner having an expandable helically extending pleat comprising at least three overlapping layers of material, the side edges of the helical pleat comprising at least two parallel helically extending marginal lines substantially in alignment with and underlying the butt joint in the body stock and including means whereby when the label is removed the line of weakness in the container defined by the butt joint separates and the helical pleat expands thereby allowing the contents of the container under pressure to press the liner outwardly between the separated edges of the butt joint and cause the can to partially open as the side edges of the butt joint move apart owing to the outward expansion of the helical pleat and the liner ruptures along one or more of the fold lines of the helical pleat and the contents of the package can then be removed throughout substantially the entire length of the container between the torn edges of the liner.

2. The can of claim 1 containing pressurized dough and the expansion of the pleat that results from the dough pressure prior to rupturing of the liner lessens the explosive force when the container is opened.

3. A dough container comprising a spirally wound body wall member formed from a paper base strip material, a liner formed from flexible sheet material adjacent the interior of the body wall member and a strip of flexible sheet material bonded to the exterior surface of the body member, the liner and strip of sheet material both being helically disposed with respect to the can axis and the marginal edges of at least the strip of flexible sheet material being offset circumferentially with respect to the line of weakness between the adjacent edge of the spirally wound body member, said body wall having a line of weakness extending helically of the can body, the liner having an expandable helically extending pleat comprising at least three overlapping layers of material and at least two parallel helically extending marginal edge lines substantially in alignment with the line of weakness and underlying the line of weakness in the body stock and including means whereby when the strip is removed, the line of weakness in the body wall of the container expands allowing the helical pleat to expand outwardly between the separated edges of the line of weakness causing the can to partially open as the side edges of the line of weakness move apart and the liner being ruptured along one or more of the marginal edge lines of the helical pleat, then the contents of the package under pressure prior to said rupture can be removed along substantially the entire length of the container between the torn edges of the liner whereby the expansion of the contents prior to the rupturing of the liner reduces the explosive force upon opening due to the pressure of the contents of the container.

4. The container of claim 3 wherein the strip of sheet material is a label bonded over substantially the entire exterior surface of the body member.

5. The container of claim 3 wherein the strip of sheet material is a tape removably bonded over the line of weakness.

6. The container of claim 3 wherein the can is filled with a food product under pressure and closure members are fastened to each end of the can body to seal the same.

7. The container according to claim 3 wherein the ends comprise circular sheet metal disks seamed to the ends of the body wall.

8. The container of claim 3 wherein the liner comprises a helically extending strip of sheet material composed of at least one layer of a metal foil, the side edges of the foil are bonded together and the pleat comprises an expandable zigzag fold comprising three layers of material terminating on each side edge in two parallel helically extending marginal lines connected by an intermediate liner panel.

9. The container according to claim 8 wherein a seal exists between the free edges of the liner comprising one of the marginal lines of the zigzag pleat.

10. The container of claim 3 wherein the label comprises a laminate of metal foil and paper and a circumferentially extending collar cut is provided near one end of the container at least through the label to define a lifting tab to facilitate removal of the label.

11. The container according to claim 3 wherein an adhesive free area is provided between the pleat and the body wall of the container, the adhesive free area being at least as wide as the pleat.

12. The container of claim 3 wherein the label extends around the entire circumference of the body stock layer and a temporarily reinforcing tape is bonded over the butt joint between the label and the body layer to temporarily retain the line of weakness intact after the label has been removed.

13. The container of claim 12 wherein the tape is divided into a plurality of segments divided by perforated lines.

14. The container of claim 13 wherein the segments are spaced helically from one another and each spaced apart section is bonded across the line of weakness to retain the weakness entact.

15. The container of claim 13 wherein the tape is divided into a plurality of separate spaced apart pieces.

* * * * *